US009962947B2

(12) United States Patent
Fujii

(10) Patent No.: US 9,962,947 B2
(45) Date of Patent: May 8, 2018

(54) METHOD OF MANUFACTURING LIQUID EJECTION HEAD AND LIQUID EJECTION HEAD

(71) Applicant: CANON KABUSHIKI KAISHA, Tokyo (JP)

(72) Inventor: Tatsunori Fujii, Komae (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 824 days.

(21) Appl. No.: 14/295,510

(22) Filed: Jun. 4, 2014

(65) Prior Publication Data

US 2014/0360595 A1 Dec. 11, 2014

(30) Foreign Application Priority Data

Jun. 11, 2013 (JP) ..... 2013-122790

(51) Int. Cl.
*B41J 2/16* (2006.01)
*B41J 2/175* (2006.01)

(52) U.S. Cl.
CPC ..... *B41J 2/17513* (2013.01); *B41J 2/1603* (2013.01); *B41J 2/1623* (2013.01); *B41J 2/1753* (2013.01); *B41J 2/17553* (2013.01); *Y10T 29/49401* (2015.01); *Y10T 137/6851* (2015.04)

(58) Field of Classification Search
CPC .... B41J 2/1623; B41J 2/17513; B41J 2/1753; B41J 2/17553; B41J 2/1603; H05K 13/0061; H05K 13/0023; H05K 13/0015; H05K 13/00; H05K 13/0469; H05K 13/046; H05K 13/04; Y10T 29/49401; Y10T 29/53174; Y10T 29/53191; Y10T 29/53261; Y10T 137/6851
USPC ..... 29/890.1, 890.09, 592.1, 830; 137/343
See application file for complete search history.

(56) References Cited

U.S. PATENT DOCUMENTS 5,439,728 A * 8/1995 Morozumi ..... B41J 2/14233 347/47
5,767,612 A * 6/1998 Takeuchi ..... B41J 2/161 310/324
6,238,508 B1 * 5/2001 Hauer ..... C09J 5/06 156/273.3

(Continued)

FOREIGN PATENT DOCUMENTS

JP 2012-240210 A 12/2012

*Primary Examiner* — Peter DungBa Vo
*Assistant Examiner* — Kaying Kue
(74) *Attorney, Agent, or Firm* — Fitzpatrick, Cella, Harper & Scinto

(57) ABSTRACT

A print element substrate is absorbed and held by a handling jig to define a predetermined location and position of the print element substrate with respect to the supporting member. In this instance, the handling jig is provided with a convex portion. Therefore, when the print element substrate is joined to the supporting member, the convex portion comes into contact with a surface of the supporting member, so that it is possible to define the height of the print element substrate with respect to the joining surface. This makes it possible to control the amount and height of squash by the print element substrate exerted on the adhesive agent applied on the joining surface. It is possible to prevent the redundant adhesive agent from spilling out in a print liquid flow path.

7 Claims, 5 Drawing Sheets

(56) References Cited

U.S. PATENT DOCUMENTS

| | | | | |
|---|---|---|---|---|
| 6,241,335 | B1 * | 6/2001 | Suzuki | B41J 2/1601 29/890.1 |
| 6,652,702 | B2 * | 11/2003 | Miyazaki | B41J 2/14024 156/272.2 |
| 7,364,284 | B2 * | 4/2008 | Hatsui | B41J 2/14072 347/59 |
| 8,201,923 | B2 * | 6/2012 | Fujii | B41J 2/14024 347/47 |
| 8,272,130 | B2 * | 9/2012 | Miyazaki | B41J 2/1623 29/890.1 |
| 8,950,072 | B2 * | 2/2015 | Kaneko | B41J 2/14072 29/611 |
| 2005/0285904 | A1 * | 12/2005 | Toge | B41J 2/14072 347/58 |
| 2007/0216728 | A1 * | 9/2007 | Ito | B41J 2/14209 347/48 |
| 2009/0165300 | A1 * | 7/2009 | Furuhata | B41J 2/1612 29/890.1 |
| 2009/0237452 | A1 * | 9/2009 | Kurihara | B41J 2/14145 347/44 |
| 2009/0303278 | A1 * | 12/2009 | Miyazaki | B41J 2/1623 347/20 |
| 2010/0149261 | A1 * | 6/2010 | Fujii | B41J 2/14024 347/44 |
| 2011/0083758 | A1 * | 4/2011 | Tsujiuchi | B29C 65/1635 137/561 R |

* cited by examiner

METHOD OF MANUFACTURING LIQUID EJECTION HEAD AND LIQUID EJECTION HEAD

BACKGROUND OF THE INVENTION

Field of the Invention

The present invention relates to a method of manufacturing a liquid ejection head and a liquid ejection head, and more specifically to a joining method for the case of joining a print element substrate, which is provided with an ejection port for ejecting a liquid such as ink, to a supporting member.

Description of the Related Art

Japanese Patent Laid-Open No. 2012-240210 discloses the technique for use in manufacturing a liquid ejection head for ejecting a liquid such as ink, which reduces a spill-out of an adhesive agent at the time of joining a print element substrate to a supporting member by an adhesive agent. More specifically, in Japanese Patent Laid-Open No. 2012-240210, in order to join the print element substrate to the supporting member, an adhesive agent is applied on a joining surface of the supporting member in the first place. Then, the print element substrate is brought into contact with the adhesive agent at the position above the joining surface for a predetermined height. In this instance, a convex portion is provided on the supporting member so that the print element substrate is brought into contact with the convex portion to join them to each other, thereby preventing the adhesive agent from being squished beyond necessary. This can prevent a redundant adhesive agent from being spilled out in a liquid flow path by squishing. As a result, it is possible to prevent the problem before it occurs, in which a liquid flow is blocked by the redundant adhesive agent spilled out in the liquid flow path and involves and traps. Suppressing the spill-out of the adhesive agent in this manner is particularly effective in a downsized liquid ejection head which is provided with a relatively narrow liquid flow path formed in the supporting member.

Then, the adhesive agent described above may contain filler for adjusting the viscosity, and the filler may be coagulated to form an aggregate of several tens of micrometers in size. In this case, the technique in Japanese Patent Laid-Open No. 2012-240210 may cause a problem in which the print element substrate cannot be correctly joined to the convex portion on the supporting member due to such an aggregate.

More specifically, as shown in FIGS. 1A 1B and 1C, in Japanese Patent Laid-Open No. 2012-240210, a convex portion 116 is provided on a supporting member 109. When a print element substrate 101 is bonded to the supporting member 109 by an adhesive agent 104, an aggregate 105 generated in the adhesive agent 104 may be sandwiched and included between the convex portion 116 and the print element substrate 101 at the position where the distance must be zero. In consequence, the print element substrate 101 cannot be appropriately brought into contact with the convex portion 116, so that the amount of spilled adhesive agent cannot be appropriately controlled. In addition thereto, the bonding itself may be inappropriate. As a result, the problem of leakage of the liquid will arise in which the adhesive agent runs out through an inappropriate portion, for example, thereby reducing production yields.

In addition, in order to prevent the problem described above before it occurs, it can be considered that the aggregate is crushed so as to bring the convex portion into appropriate contact with the print element substrate. This requires, however, a relatively large force, such as 20N. In this case, the crushing force results in damage given to the print element substrate, or misalignment of bonding position of the print element substrate.

SUMMARY OF THE INVENTION

An object of the present invention is to provide a method of manufacturing a liquid ejection head capable of carrying out an appropriate control on the amount of spilled adhesive agent even if an aggregate is generated in an adhesive agent for boning a print element substrate to a supporting member, and to provide a liquid ejection head.

In a first aspect of the present invention, there is provided a method of manufacturing a liquid ejection head by joining a print element substrate for ejecting print liquid and a supporting member for supporting the print element substrate with an adhesive agent, the method comprising: a step of joining the print element substrate to the supporting member while carrying out positioning of the print element substrate with respect to the supporting member by a handling jig holding the print element substrate, wherein the step joins the print element substrate to the supporting member with at least one convex portion provided on the handling jig coming into contact with an area of the supporting member other than an area on which the adhesive agent is applied.

In a second aspect of the present invention, there is provided a liquid ejection head manufactured by joining a print element substrate for ejecting print liquid and a supporting member for supporting the print element substrate with an adhesive agent, wherein on the supporting member to which the print element substrate is joined by a handling jig holding the print element substrate, a contact portion with which at least one convex portion provided on the handling jig comes into contact is provided.

According to the structure described above, it is possible to carry out an appropriate control on the amount of spilled adhesive agent even if an aggregate is generated in an adhesive agent for boning a print element substrate to a supporting member.

Further features of the present invention will become apparent from the following description of exemplary embodiments (with reference to the attached drawings).

DESCRIPTION OF THE EMBODIMENTS

Embodiments of the present invention will be described below in detail with reference to attached drawings.

Figure 1A:
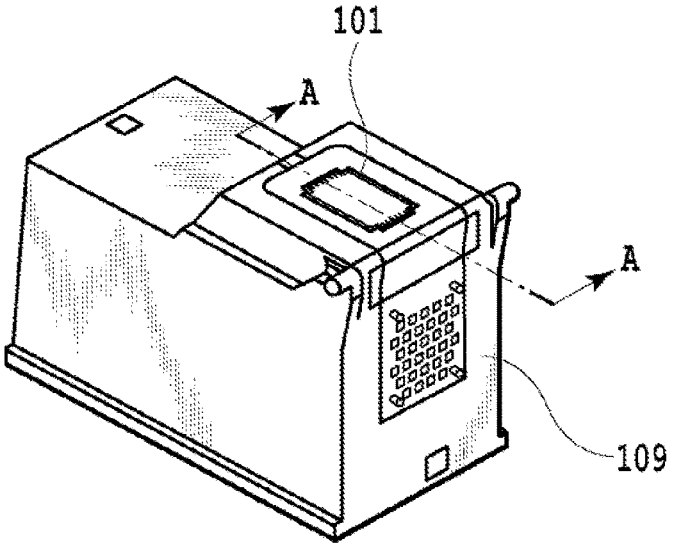
FIG. 1A is a perspective view showing a conventional liquid ejection head.
Figure 1B:
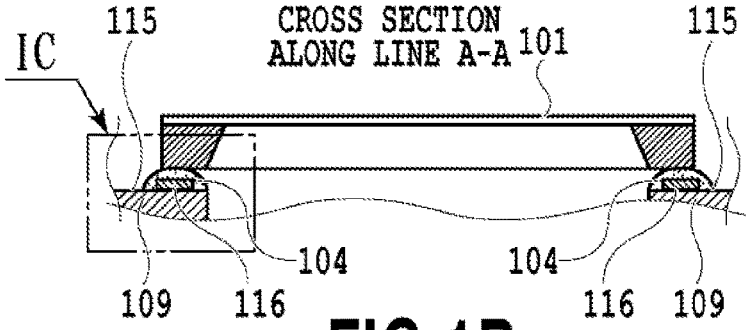
FIG. 1B is a schematic cross-sectional view showing a joining structure of a print element substrate and a supporting member.
Figure 1C:
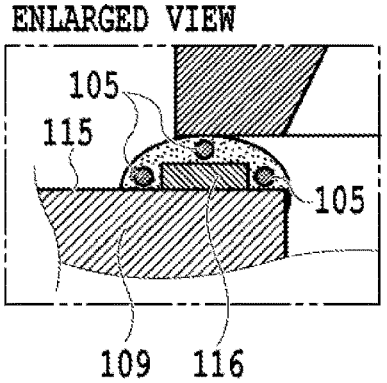
FIG. 1C is an enlarged view of a portion shown in FIG. 1B.
Figure 2:
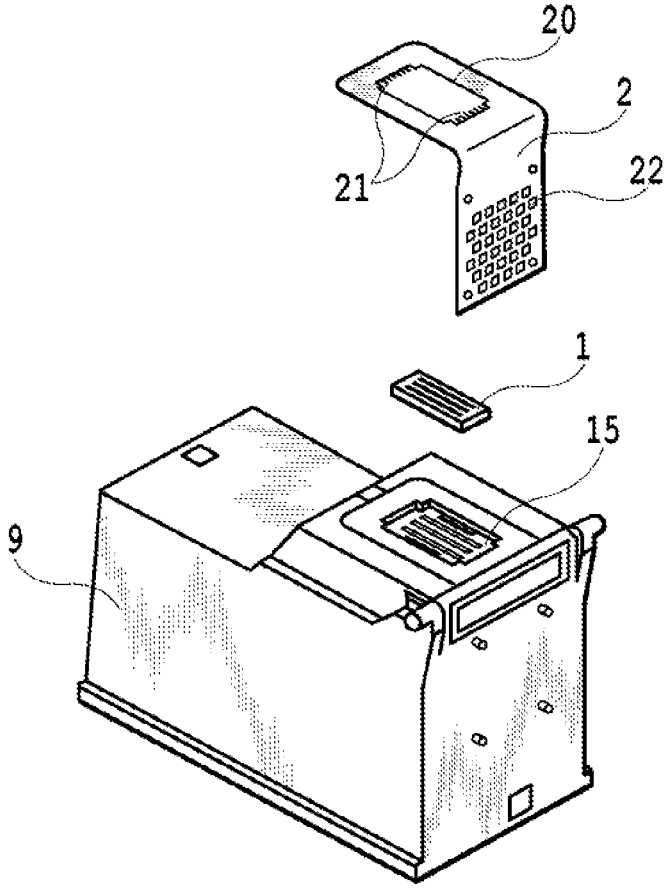
FIG. 2 is an exploded perspective view of a liquid ejection head according to an embodiment of the present invention.
Figure 3A:
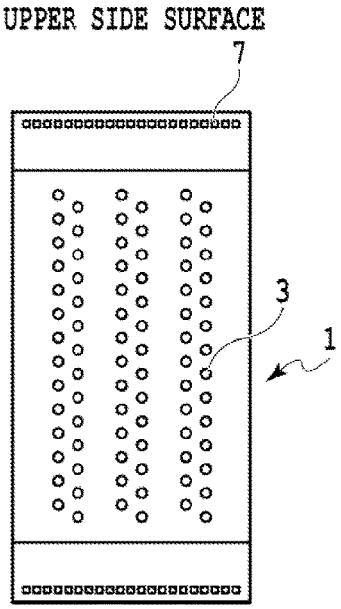
FIGS. 3A and 3B are diagrams showing a schematic structure of a print element substrate 1 according to the present embodiment.

FIG. 2 is an exploded perspective view of a liquid ejection head according to an embodiment of the present invention. The liquid ejection head according to the present embodiment shown in FIG. 2 includes a print element substrate 1 provided with ejecting opening arrays each of which ejects inks of three colors of yellow (Y), magenta (M) and cyan C (also referred to as liquids or printing liquids), respectively. Each of the three-color printing liquids is contained in its own containing chamber (not shown) in a supporting member 9. The print element substrate 1 is attached to a joining surface 15 of the supporting member 9 at the bottom thereof which is formed by molding. An electric wiring substrate 2 is attached on the supporting member 9 at the periphery of the print element substrate 1. The electric wiring substrate 2 is provided with a device hole 20 for incorporating the print element substrate 1, and electrode terminals 21 corresponding to electrodes 7 of the print element substrate 1 (FIG. 3A). Furthermore, the electric wiring substrate 2 is provided with an external signal input terminal 22 for receiving a driving control signal from a printing apparatus main body. The external signal input terminal 22 and the electrode terminals 21 are coupled to each other through a copper foil wiring. In addition, in the present embodiment, the supporting member 9 is formed of a resin material including 35% glass filler mixed therein in order to improve geometrical rigidity.

Figure 3B:
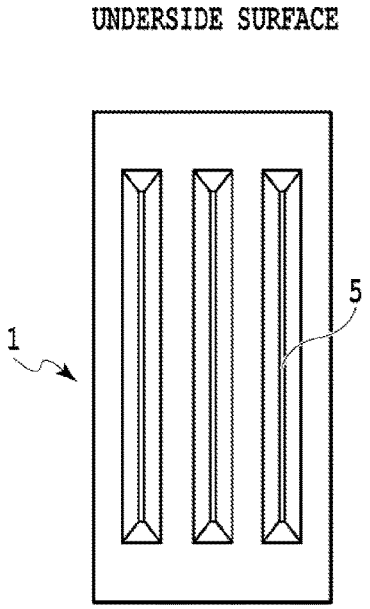

FIGS. 3A and 3B are diagrams showing a schematic structure of the print element substrate 1 according to the present embodiment. More specifically, FIG. 3A shows a surface facing the side of a print medium such as a print sheet at the time of printing (also referred to as an upper side surface), and FIG. 3B shows the backside thereof to be joined to the supporting member 9 (also referred to as an underside surface). a heating element (not shown) for generating energy for ejecting a print liquid, a flow path (not shown), ejection openings 3, and print liquid supplying ports 5 are previously formed on the print element substrate 1. The upper side surface of the print element substrate 1 is provided with electrodes 7 to be connected to the electrode terminals 21 of the electric wiring substrate 2.

First Embodiment

Figure 4B:
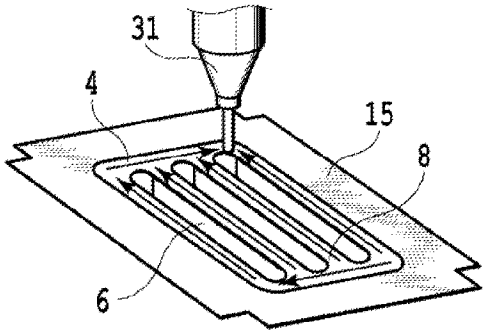
FIGS. 4A to 4D are views explaining a method of manufacturing a liquid ejection head according to a first embodiment of the preset invention.
Figure 4D:
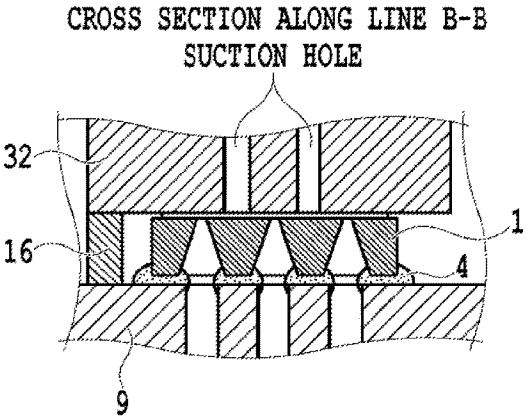
Figure 4A:
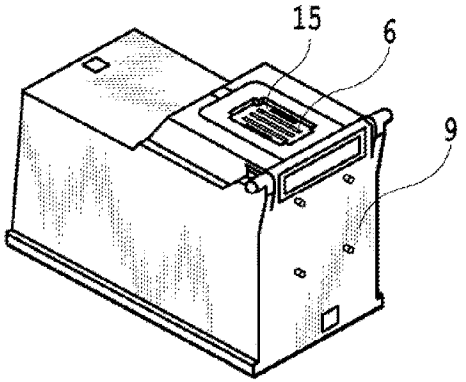

FIGS. 4A to 4D are views explaining a manufacturing process of a liquid ejection head according to a first embodiment of the preset invention. As shown in FIGS. 4A and 4B, the supporting member 9 and the joining surface 15 of the liquid ejection head of the present embodiment are formed by molding. In the supporting member 9, three print liquid supply paths 6 for respectively supplying three color print liquids, and partition walls 8 for partitioning the supply paths as those separated from one another.

Figure 4C:
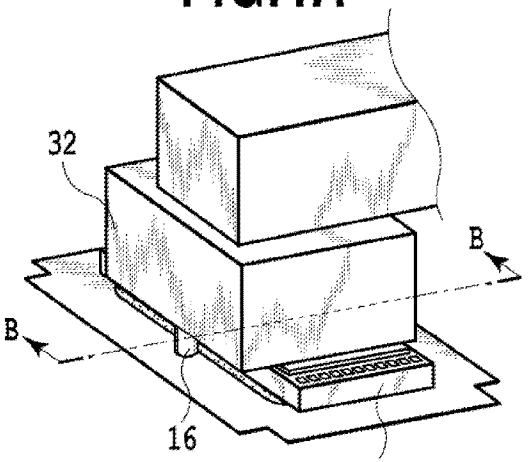

As shown in FIG. 4B, the manufacturing process of the liquid ejection head starts from applying an adhesive agent 4 on the joining surface 15 by moving a dispenser 31 in the directions indicated by arrows. The adhesive agent used in the present embodiment includes filler for adjusting viscosity. Next, as shown in FIGS. 4C and 4D, the print element substrate 1 is absorbed and held by a handling jig 32 in order to carry out the positioning of the print element substrate 1 with respect to the supporting member 9. More specifically, the handling jig 32 holding the print element substrate 1 determines predetermined location and position of the print element substrate 1. In this instance, the handling jig 32 is provided with the convex portion 16. Therefore, when the print element substrate 1 is joined to the supporting member 9, the convex portion 16 comes into contact with an area of the supporting member 9 other than an area on which the adhesive agent is applied, so that it is possible to determine the height of the print element substrate 1 with respect to the joining surface 15. This makes it possible to control the amount and height of squash by the print element substrate 1 exerted on the adhesive agent 4 applied on the joining surface 15. It is thus possible to prevent the redundant adhesive agent from spilling out in the print liquid supply path 6. Then, since an area with which the convex portion 16 comes into contact is the area of the supporting member 9 on which the adhesive agent 4 is not applied, it is possible to carry out the suitable joining to reduce the distance between the convex portion 16 and the joining surface 15 to zero without the influence by an aggregate even if the aggregate is generated in the adhesive agent.

The handling jig 32 is provided with a heater (not shown) which can apply heat to the print element substrate 1. Therefore, it is possible to heat the adhesive agent 4 to facilitate the hardening of the adhesive agent when the print element substrate 1 is joined to the supporting member 9. Furthermore, it is possible to provide sealing without space between the supporting member 9 and the print element substrate 1.

In addition, although the present embodiment has described the example in which the handling jig 32 is provided with one convex portion 16, the number of convex portions is not limited to this. For example, the handling jig 32 may be provided with two, three or more convex portions so as to surround the print element substrate 1.

Second Embodiment

Figure 5B:
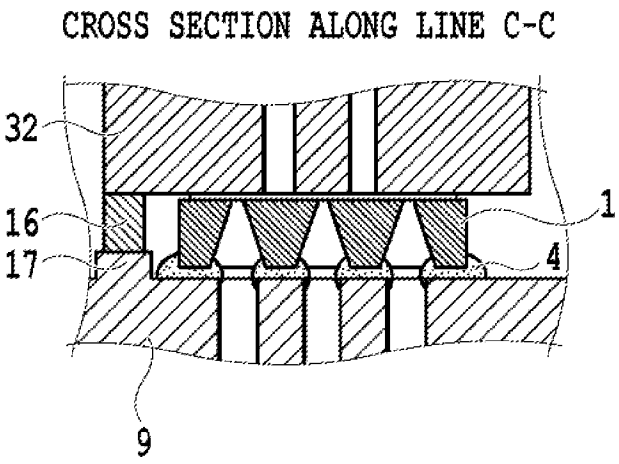
FIGS. 5A and 5B are views explaining a manufacturing process of a liquid ejection head according to a second embodiment of the present invention.
Figure 5A:
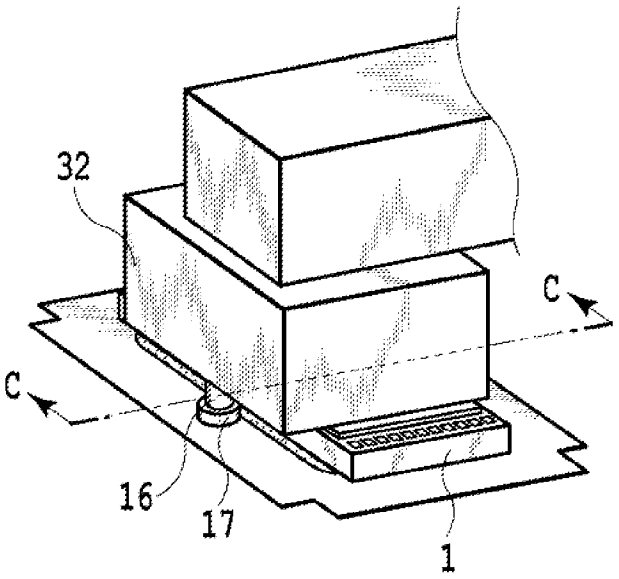

FIGS. 5A and 5B are views explaining a manufacturing process of a liquid ejection head according to a second embodiment of the present invention. The difference from the first embodiment described above is that the convex portion 16 of the handling jig is not directly brought into contact with the supporting member 9, but the convex portion 16 of the handling jig is brought into contact with a contact portion 17. As shown in FIGS. 5A and 5B, the contact portion 17 having a flatness precision equal to or higher than a flatness precision of a portion to which the adhesive agent is applied is provided at the portion on the supporting member 9 to which no adhesive agent is applied, and the convex portion 16 of the handling jig is brought into contact with this contact portion. Preferably, the flatness precision of the contact portion is made higher than that of portion to which the adhesive agent is applied. Thereby, it is possible to keep the height of the print element substrate 1 always constant with respect to the joining surface 15, and thus to accurately control the amount of squash by the print element substrate 1 exerted on the adhesive agent 4 applied on the joining surface 15. More specifically, it is generally difficult for the supporting member made of resin to provide flatness over a wide area, so that providing the contact portion 17 makes it possible to provide higher flatness. It is preferable that a top surface of a protrusion functions as the contact portion as the present embodiment, because an area of the contact portion is made small so that the flatness precision can be easily made higher. In addition, it is preferable that the protrusion as the contact portion has an advantage in which the adhesive agent is prevented from moving up.

In addition, although the present embodiment has described the example of providing one contact portion 17, the number of contact portions is not limited to this. As described above in the first embodiment, two, three or more contact portions may be provided corresponding to the convex portion provided in the handling jig 32. It is preferable that three contact portions are provided for improving a location accuracy of the print element substrate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-122790, filed Jun. 11, 2013 which is hereby incorporated by reference herein in its entirety.

What is claimed is:

1. A method of manufacturing a liquid ejection head by joining a print element substrate for ejecting print liquid and a supporting member for supporting the print element substrate with an adhesive agent, the method comprising:

a step of providing the supporting member having a projection and a handling jig having a protrusion portion outside an application area to which the adhesive agent is applied; and a step of joining the print element substrate to the supporting member while carrying out positioning of the print element substrate with respect to the supporting member by the handling jig holding the print element substrate, wherein joining in the joining step is performed while a flat top portion of the protrusion portion of the handling jig is in contact with a flat top surface of the projection of the supporting member.

2. The method as claimed in claim 1, wherein the joining step joins the print element substrate to the supporting member with at least one protrusion portion provided on the handling jig coming into contact with a contact portion that has a flatness precision equal to or higher than a flatness precision of an area to which the adhesive agent is applied, the contact portion being provided on the supporting member.

3. The method as claimed in claim 1, wherein the joining step joins the print element substrate to the supporting member with at least one protrusion portion provided on the handling jig coming into contact with a contact portion that has a flatness precision higher than a flatness precision of an area to which the adhesive agent is applied, the contact portion being provided on the supporting member.

4. The method as claimed in claim 3, wherein the contact portion is the flat top surface of the projection of the supporting member.

5. The method as claimed in claim 1, wherein the joining step applies heat to the print element substrate by the handling jig to facilitate hardening of the adhesive agent when joining the print element substrate to the supporting member.

6. The method as claimed in claim 1, wherein the adhesive agent contains a filler.

7. The method as claimed in claim 1, wherein the handling jig is provided with the three protrusion portions.

* * * * *